US005724946A

United States Patent [19]

Franchitto

[11] Patent Number: 5,724,946

[45] Date of Patent: Mar. 10, 1998

[54] FUEL RAIL AND INJECTOR ASSEMBLY

[75] Inventor: Anthony Louis Franchitto, Virginia Beach, Va.

[73] Assignee: Siemens Automotive Corporation, Auburn Hills, Mich.

[21] Appl. No.: 755,053

[22] Filed: Nov. 22, 1996

[51] Int. Cl.[6] ..... F02M 55/02

[52] U.S. Cl. ..... 123/470; 123/468

[58] Field of Search ..... 123/468, 469, 123/470, 472

[56] References Cited

U.S. PATENT DOCUMENTS

| | | | |
|---|---|---|---|
| 4,647,012 | 3/1987 | Gartner | 123/470 |
| 4,971,014 | 11/1990 | Usui . | |
| 4,979,295 | 12/1990 | Stagni et al. | 123/470 |
| 5,035,224 | 7/1991 | Hornby et al. . | |
| 5,038,738 | 8/1991 | Hafner et al. . | |
| 5,121,731 | 6/1992 | Jones . | |
| 5,140,963 | 8/1992 | Brackett et al. . | |
| 5,167,213 | 12/1992 | Bassler et al. . | |
| 5,209,204 | 5/1993 | Bodenhausen et al. | 123/470 |
| 5,551,400 | 9/1996 | Rice et al. . | |

FOREIGN PATENT DOCUMENTS

| | | |
|---|---|---|
| 2188670A | 7/1990 | Japan . |

*Primary Examiner*—Thomas N. Moulis
*Attorney, Agent, or Firm*—Russel C. Wells

[57] ABSTRACT

A fuel rail and injector assembly include a fuel delivery rail having an injector cup and a fuel injector having a mounting end mountable in the injector cup. The injector cup includes a receiving section having a necked down portion and a retaining portion, integral with the injector cup. The fuel injector mounting end includes an integral engaging section urgeable through the necked down portion and receivable in the retaining portion for snap fastening together the fuel injector and the fuel rail injector cup.

7 Claims, 2 Drawing Sheets

FUEL RAIL AND INJECTOR ASSEMBLY

FIELD OF THE INVENTION

This invention relates to a fuel rail and injector assembly for an internal combustion engine and more particularly to a connecting arrangement for snap fastening together a fuel rail injector cup and a mounting end of a fuel injector.

BACKGROUND OF THE INVENTION

It is known in the art relating to fuel rail and injector assemblies to mount a mounting end of a fuel injector in a fuel rail injector cup utilizing an assembly including an injector clip or other intermediary connecting member to effect the connection. The well known injection clip complicates the connection and increases the cost of the assembly.

SUMMARY OF THE INVENTION

The present invention provides a fuel rail and injector assembly that snap fastens together and eliminates the necessity for an injector clip or other intermediary connector member.

The fuel rail and injector assembly includes a fuel delivery rail having an injector cup and a fuel injector having a mounting end mountable in the injector cup. The injector cup includes a receiving section having a necked down portion and a retaining portion integral with the injector cup, The fuel injector mounting end includes an engaging section that is urgeable through the necked down portion of the injector cup and receivable in the retaining portion of the cup. The engaging section is integral with the injector mounting end and provides snap fastening together of the fuel injector and the fuel rail injector cup, eliminating an injector clip or other intermediary connector member.

In one embodiment, the receiving section extends circumferentially around the inside wall of the injector cup and the engaging section extends circumferentially around the outer periphery of the mounting end of the fuel injector. In this embodiment, either the receiving section or engaging section is formed of a yieldable polymeric or metallic material to allow for the deformation required for the engaging section to pass through the necked down portion of the injector cup wall.

In an alternate embodiment, the receiving section is a locking groove having the necked down and receiving portions extending generally axially in the wall of the injector cup. In this embodiment, the engaging section is a locking pin projecting generally radially from the fuel injector mounting end. The locking pin is receivable in the receiving portion of the injector cup after passing through the necked down portion in the locking groove. Alternatively, the locking groove may be formed to extend through the wall thickness of the injector cup thereby forming a slot or the locking groove may only extend partially into the wall of the injector cup.

The locking groove can be formed to include an arcuate terminus that extends from the axial toward the circumferential direction in the retaining portion of the receiving section. The arcuate terminus provides that the fuel injector can be rotated and the locking pin further engaged in bayonet fashion.

These and other features and advantages of the invention will be more fully understood from the following detailed description of the invention taken together with the accompanying drawings.

DETAILED DESCRIPTION OF THE INVENTION

Figure 1:
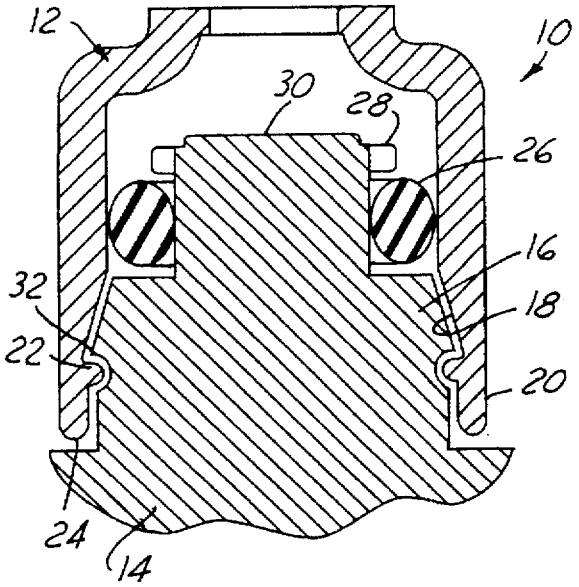
FIG. 1 is a cross sectional view of a fuel rail injector cup of a polymeric material and mounting end of a fuel injector mounted in said injector cup in accordance with the present invention.
Figure 2:
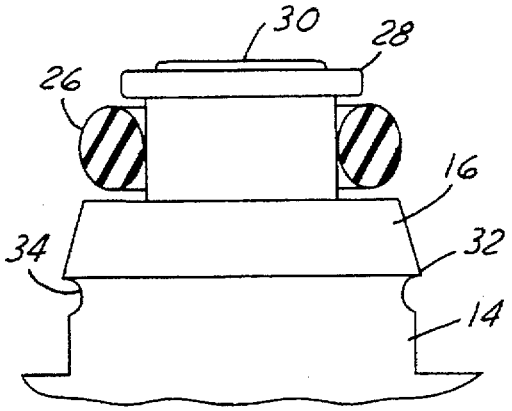
FIG. 2 is a side sectional view of the mounting end of the fuel injector of FIG. 1 illustrating a circumferential locking groove.
Figure 3:
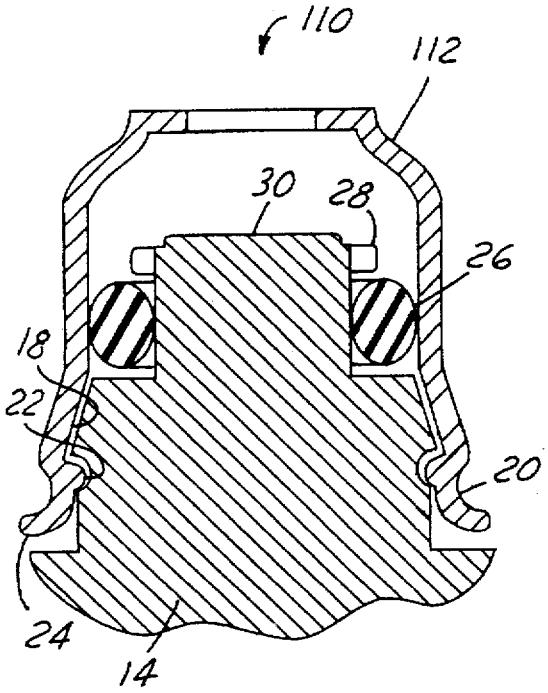
FIG. 3 is a cross sectional view of a fuel rail injector cup of a metallic material and mounting end of a fuel injector mounted in said injector cup in accordance with the present invention.

Referring first to FIGS. 1–3 of the drawings in detail, numerals 10,110 generally indicate a fuel rail and injector assembly for an automotive engine including an injector cup 12,112 of a fuel delivery rail, not shown, and a fuel injector 14 having a mounting end 16 mountable in the injector cup. As is hereinafter more fully described, the assembly provides for snap fastening together of the fuel injector mounting end and fuel injector cup, and eliminates the need for conventional injector clips to facilitate the connection.

Referring to FIGS. 1 and 2 there is shown an injector cup 12 of a polymeric material. The injector cup 12 includes a receiving section 18 having a necked down portion 20 and a retaining portion 22 proximate the open end 24 of the injector cup. The mounting end 16 of fuel injector 14 includes an o-ring 26 and washer 28 assembly proximate the distal end 30 of the fuel injector. The mounting end 16 also includes an engaging section 32 urgeable through the necked down portion 20 and receivable in the retaining portion 22 to effect a snap-fit mounting of the injector 14 in the injector cup 12.

The receiving section 18 and engaging section 32 extend circumferentially around the injector cup 12 and fuel injector mounting end 16 respectively and are integral therewith. As seen in FIGS. 1 and 2, the mounting end 16 of the fuel injector 14 also includes a circumferential recess 34 for receiving the necked down portion 20 of the receiving section 18 of the injector cup 12 in the mounted position of the fuel injector 14.

FIG. 3 illustrates an injector cup 112 of a yieldable metallic material for receiving the mounting end of fuel injector 14.

Figure 4:
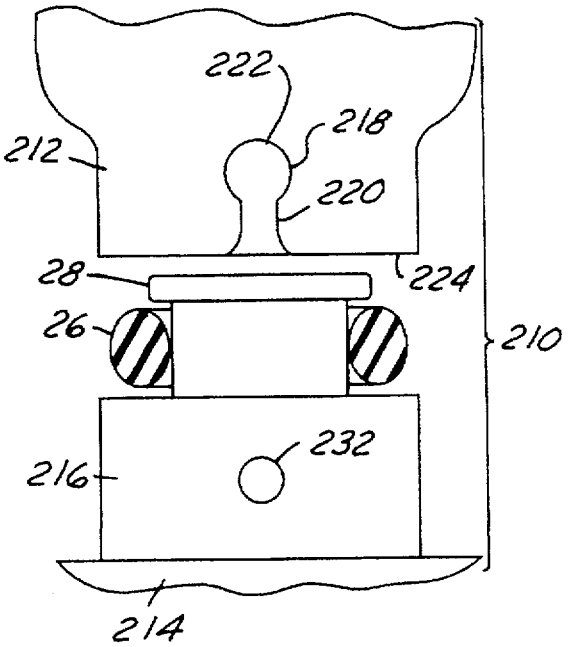
FIG. 4 is an assembly view of a fuel rail injector cup and mounting end of a fuel injector configured for mounting in said fuel rail injector cup in accordance with an alternate embodiment of the invention.

Referring to FIGS. 4 thru 7, there is shown an alternative embodiment 210,310 of the fuel injector cup 212,312 and fuel injector mounting end 216,316. With reference to FIG. 4, the receiving section 218 is a locking groove or slot extending generally axially from the open end 224 of the injector cup 212 through the cup wall thickness. The engaging section 232 of the fuel injector mounting end 216 is a locking pin projecting generally radially from the fuel injector mounting end. To mount the fuel injector 214, the locking pin 232 is received in the locking groove 218, urged past the necked down portion 220, and received in the retaining portion 222 of the locking groove. In addition to providing a snap fastening arrangement, this embodiment provides for rotational indexing of the fuel injector 214 relative to the injector cup 212 and fuel rail.

Figure 5:
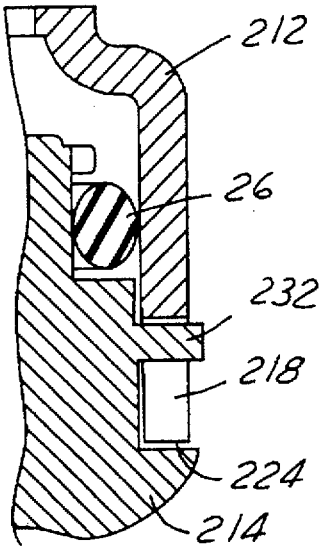
FIGS. 5 and 6 are fragmentary cross sectional views of a fuel rail injector cup and mounting end of a fuel injector mounted in said injector cup illustrating, respectively, a slot through the injector cup wall connection and a groove in the wall connection.
Figure 6:
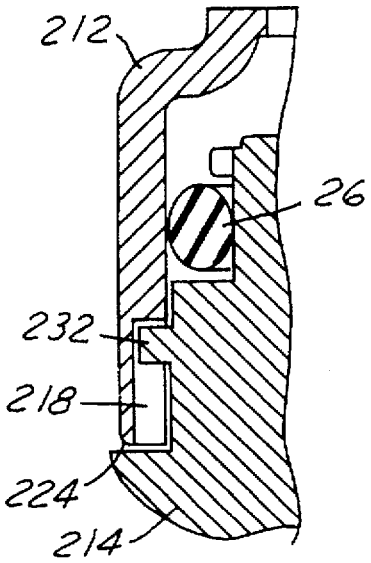

FIGS. 5 and 6 illustrate alternative versions of the locking groove 218,218' and locking pin 232 mounting arrangement of the fuel injector 214 in the injector cup 212. In FIG. 5, the locking groove 218 extends completely through the injector cup wall as shown in FIG. 4, while in FIG. 6, the locking groove 218' is confined within the injector cup wall.

Figure 7:
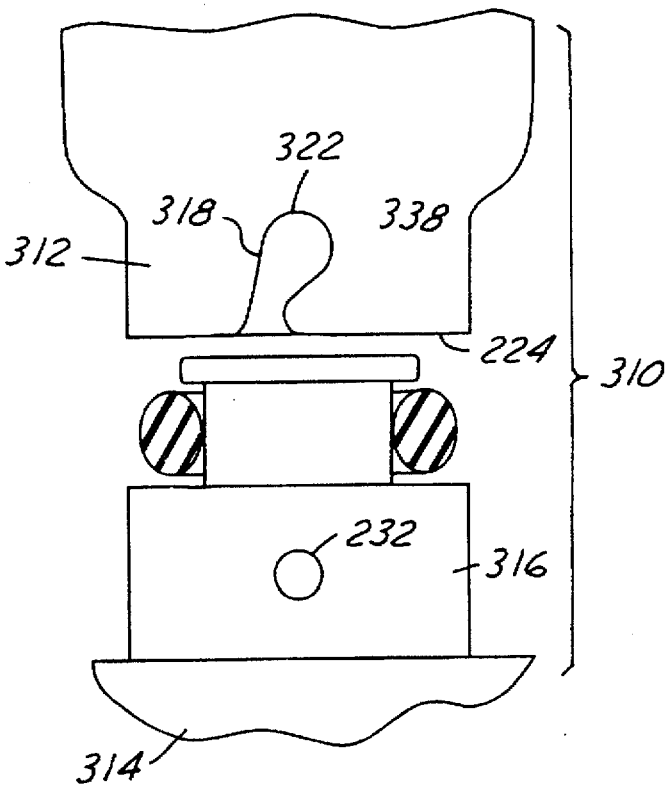
FIG. 7 is an assembly view of a fuel rail injector cup and mounting end of a fuel injector configured for mounting in said fuel rail injector cup in accordance with a modified version of the alternate embodiment of FIG. 4.

In FIG. 7, the locking groove and locking pin mounting arrangement 310 is shown modified to include an arcuate terminus 338 in the retaining portion 322. This arcuate terminus 338 extends from a generally axial direction to a generally circumferential direction allowing the fuel injector 314 to be rotated and causing a further locking of the locking pin 232 in the locking groove 318 in bayonet fashion.

Upon assembly of any of the embodiments shown in an engine fuel injection system, the snap fastening of the injector within its mating injector cup engages the o-ring with the cup wall, sealing the connection against fuel leakage. The interference fitting of the engaging section of the fuel injector mounting end with the necked down portion of the injector cup receiving section is sufficient to retain the injector in position after snap assembly with the engaging section received within the cup retaining portion.

The axial pin arrangements of FIGS. 4–7 additionally provide indexing of the installed injector and the bayonet groove of FIG. 7 adds an additional means of retention of the injector in the cup.

Although the invention has been described by reference to specific embodiments, it should be understood that numerous changes may be made within the spirit and scope of the inventive concepts described. Accordingly, it is intended that the invention not be limited to the described embodiments, but that it have the full scope defined by the language of the following claims.

What is claimed is:

1. A fuel rail and injector assembly including a fuel delivery rail having an injector cup and a fuel injector having a mounting end mountable in the injector cup, said assembly characterized by:

a receiving section integral with and extending circumferentially around the injector cup including a necked down portion and retaining portion, and an engaging section integral with and extending circumferentially around the injector mounting end urgeable through said necked down portion and receivable in said retaining portion for snap fastening together the fuel injector and the fuel rail injector cup.

2. An assembly as in claim 1 characterized in that:

one of said receiving section and engaging section is of a yieldable polymeric material.

3. An assembly as in claim 1 characterized in that:

one of said receiving section and engaging section is of a yieldable metallic material.

4. (Amended) An assembly as in claim 1 characterized in that:

the mounting end of the fuel injector also includes a circumferential recess for receiving said necked down portion of said receiving section of the injector cup in the mounted position of the fuel injector in the injector cup.

5. An assembly as in claim 1 characterized in that:

said receiving section is a locking groove in the wall of the injector cup and said engaging section is a locking pin projecting generally radially from the fuel injector mounting end.

6. An assembly as in claim 5 characterized in that:

said locking groove extends through the wall of the injector cup thereby forming a slot.

7. An assembly as in claim 5 characterized in that:

said locking groove includes an arcuate terminus in said retaining portion whereby the fuel injector can be rotated and said locking pin further engaged in bayonet fashion in said locking groove.

* * * * *